US008143558B2

(12) United States Patent
Kladias et al.

(10) Patent No.: US 8,143,558 B2
(45) Date of Patent: Mar. 27, 2012

(54) APPARATUSES USEFUL FOR PRINTING AND METHODS FOR CONTROLLING THE TEMPERATURE OF MEDIA IN APPARATUSES USEFUL FOR PRINTING

(75) Inventors: Nicholas P. Kladias, Fresh Meadows, NY (US); Gerald A. Domoto, Briarcliff Manor, NY (US); Augusto E. Barton, Webster, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 562 days.

(21) Appl. No.: 12/352,824

(22) Filed: Jan. 13, 2009

(65) Prior Publication Data

US 2010/0176117 A1 Jul. 15, 2010

(51) Int. Cl.
*G03G 15/20* (2006.01)
*H05B 11/00* (2006.01)
*B21B 27/06* (2006.01)

(52) U.S. Cl. ..... 219/470; 219/469; 399/67; 399/69

(58) Field of Classification Search ..... 219/471, 219/216; 432/59, 60
See application file for complete search history.

(56) References Cited

U.S. PATENT DOCUMENTS 4,549,803 A * 10/1985 Ohno et al. ..... 399/45
6,496,666 B2 * 12/2002 Hayashi et al. ..... 399/69
6,741,446 B2 * 5/2004 Ennis ..... 361/234
7,239,838 B2 * 7/2007 Sato et al. ..... 399/329
7,361,863 B2 * 4/2008 Tsunoda ..... 219/216
7,532,834 B2 * 5/2009 Kagawa et al. ..... 399/69
7,869,729 B2 * 1/2011 Hachisuka ..... 399/68
2003/0147680 A1 * 8/2003 Kawamura et al. ..... 399/329
2005/0129432 A1 * 6/2005 Sato et al. ..... 399/329
2007/0092277 A1 * 4/2007 Miyata et al. ..... 399/69
2008/0037069 A1 2/2008 Mestha et al.

* cited by examiner

*Primary Examiner* — Joseph M Pelham
*Assistant Examiner* — Diallo I Duniver
(74) *Attorney, Agent, or Firm* — Ronald E. Prass, Jr.; Prass LLP

(57) ABSTRACT

Apparatuses useful for printing and methods for controlling the temperature of media in apparatuses useful for printing are disclosed. An embodiment of the apparatuses includes a heated first roll including a first outer surface; a heated second roll including a second outer surface; a third roll including a third outer surface; a temperature sensor for sensing the temperature of the third outer surface; a belt supported on the first roll and the second roll and disposed between the first outer surface and the third outer surface, the belt including an inner surface and an outer surface; a nip between the third outer surface and the outer surface of the belt at which the belt heats media which include a surface, marking material on the surface and an interface between the surface and marking material; and a positioning device coupled to the second roll. The positioning device is operable to move the second roll relative to the outer surface of the belt to change a wrap length of the belt on the second outer surface, based on the temperature of the third outer surface, to maintain a substantially constant temperature at the interface between the surface and marking material.

22 Claims, 10 Drawing Sheets

APPARATUSES USEFUL FOR PRINTING AND METHODS FOR CONTROLLING THE TEMPERATURE OF MEDIA IN APPARATUSES USEFUL FOR PRINTING

BACKGROUND

Some printing apparatuses include a heated belt and a pressure roll that form a nip. In such apparatuses, images comprised of a marking material are formed on media and the belt and pressure roll are used to supply heat and pressure to the media at the nip.

It would be desirable to provide apparatuses useful for printing and methods for controlling the temperature of media in apparatuses useful for printing that can provide energy efficiency and consistent operation.

SUMMARY

Apparatuses useful for printing and methods for controlling the temperature of media in apparatuses useful for printing are disclosed. An embodiment of the apparatuses useful for printing comprises a heated first roll including a first outer surface; a heated second roll including a second outer surface; a third roll including a third outer surface; a temperature sensor for sensing the temperature of the third outer surface; a belt supported on the first roll and the second roll and disposed between the first outer surface and the third outer surface, the belt including an inner surface and an outer surface; a nip between the third outer surface and the outer surface of the belt at which the belt heats media which include a surface, marking material on the surface and an interface between the surface and marking material; and a positioning device coupled to the second roll. The positioning device is operable to move the second roll relative to the outer surface of the belt to change a wrap length of the belt on the second outer surface, based on the temperature of the third outer surface, to maintain a substantially constant temperature at the interface between the surface and the marking material.

DRAWINGS

DETAILED DESCRIPTION

Figure 1:
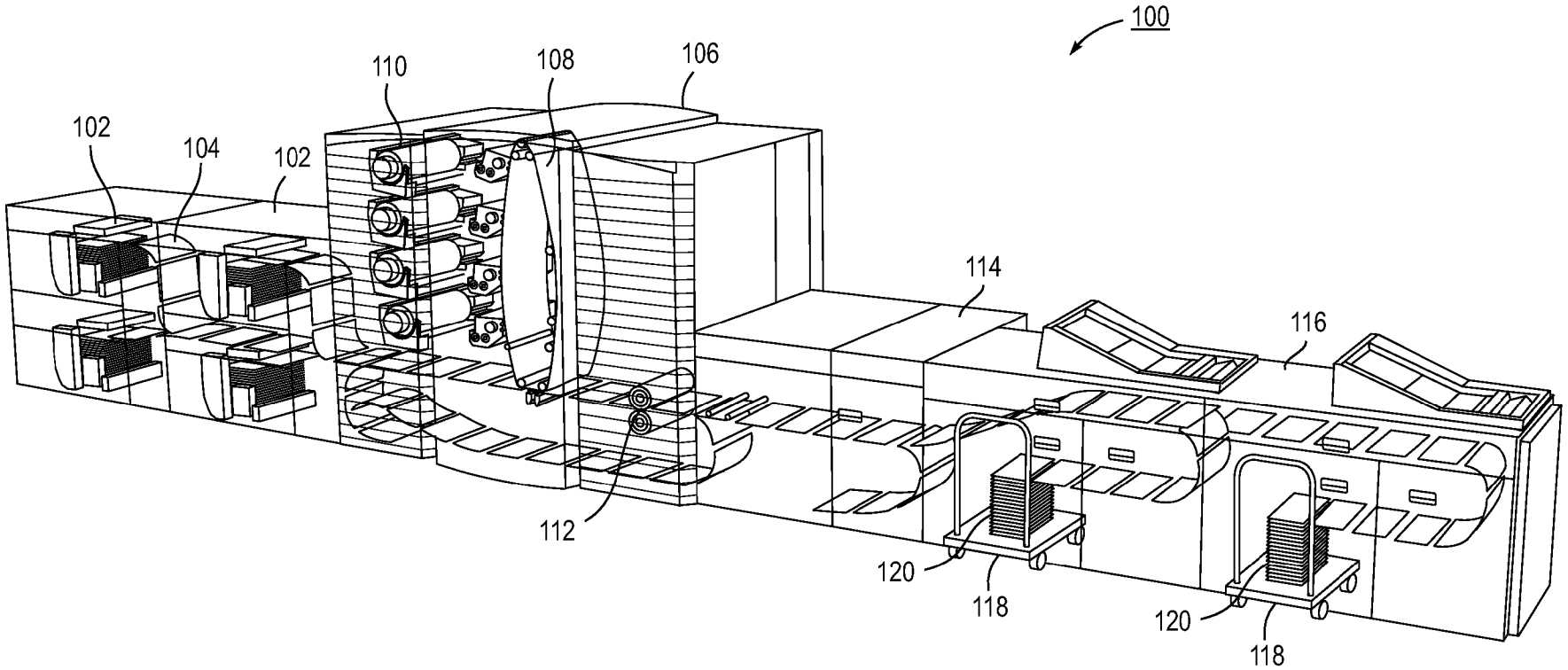
FIG. 1 illustrates an exemplary embodiment of a printing apparatus.

The disclosed embodiments include an apparatus useful for printing, which comprises a heated first roll including a first outer surface; a heated second roll including a second outer surface; a third roll including a third outer surface; a temperature sensor for sensing the temperature of the third outer surface; a belt supported on the first roll and second roll and disposed between the first outer surface and the third outer surface, the belt including an inner surface and an outer surface; a nip between the third outer surface and the outer surface of the belt at which the belt heats media which include a surface, marking material on the surface and an interface between the surface and the marking material; and a positioning device coupled to the second roll. The positioning device is operable to move the second roll relative to the outer surface of the belt to change a wrap length of the belt on the second outer surface, based on the temperature of the third outer surface, to maintain a substantially constant temperature at the interface between the surface and the marking material.

The disclosed embodiments further include an apparatus useful for printing, which comprises a heated first roll including a first outer surface; a heated second roll including a second outer surface; a third roll including a third outer surface; a first temperature sensor for sensing the temperature of the third outer surface; a continuous belt disposed between the first outer surface and the third outer surface, the belt including an inner surface which contacts the first outer surface and an outer surface which contacts the second outer surface and the third outer surface; a nip between the third outer surface and the outer surface of the belt at which the belt heats media which include a surface, marking material on the surface and an interface between the surface and the marking material; a positioning device coupled to the second roll, the positioning device being operable to move the second roll relative to the outer surface of the belt to change a wrap length of the belt on the second outer surface; and a first controller connected to the first temperature sensor and the positioning device. The first controller receives signals from the first temperature sensor and controls the positioning device to move the second roll toward or away from the outer surface of the belt to change the wrap length of the belt on the second outer surface, based on the temperature of the third outer surface, to maintain a substantially constant temperature at the interface between the surface and the marking material.

The disclosed embodiments further include a method of controlling the temperature at an interface between a surface and marking material on the surface of media in an apparatus useful for printing. The apparatus comprising a heated first roll including a first outer surface, a heated second roll including a second outer surface, a third roll including a third outer surface, and a belt contacting the first roll and second roll and disposed between the first outer surface and the third outer surface, the belt including an inner surface and an outer surface, the third outer surface and the outer surface of the belt forming a nip. The method comprises feeding at least one first medium of a first media type to the nip, wherein each first medium includes a first surface, a first marking material on the first surface and a first interface between the first surface and the first marking material; sensing the temperature of the third outer surface; and controlling a wrap length of the belt on the second outer surface, based on the temperature of the third outer surface, to maintain a substantially constant temperature at the first interface between the first surface and the first marking material of each first medium.

FIG. 1 illustrates an exemplary printing apparatus 100, such as disclosed in U.S. Patent Application Publication No. 2008/0037069, which is incorporated herein by reference in its entirety. As used herein, the term "printing apparatus" encompasses any apparatus that performs a print outputting function for any purpose. For example, the apparatus can be a digital copier, bookmaking machine, multifunction machine, and the like. In the illustrated embodiment, the printing apparatus 100 has a modular construction. As shown, the printing apparatus 100 includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 feed media to the printer module 106. In the printer module 106, a marking material including toner is transferred from a series of developer stations 110 to a charged photoreceptor belt 108 to form toner images on the photoreceptor belt 108. The toner images are transferred to one side of media 104 fed through the paper path. The media are advanced through a fuser 112 adapted to fuse the toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Apparatuses useful for printing are provided. The apparatuses include a belt and a roll forming a nip. In embodiments, the roll includes an outer surface, which engages the belt and is comprised of a deformable material. Embodiments of the apparatuses are constructed to heat and apply pressure to media on which marking material has been applied with the belt and roll. Different types (weights and compositions) and sizes of media and different marking materials can be used in the apparatuses.

Figure 2:
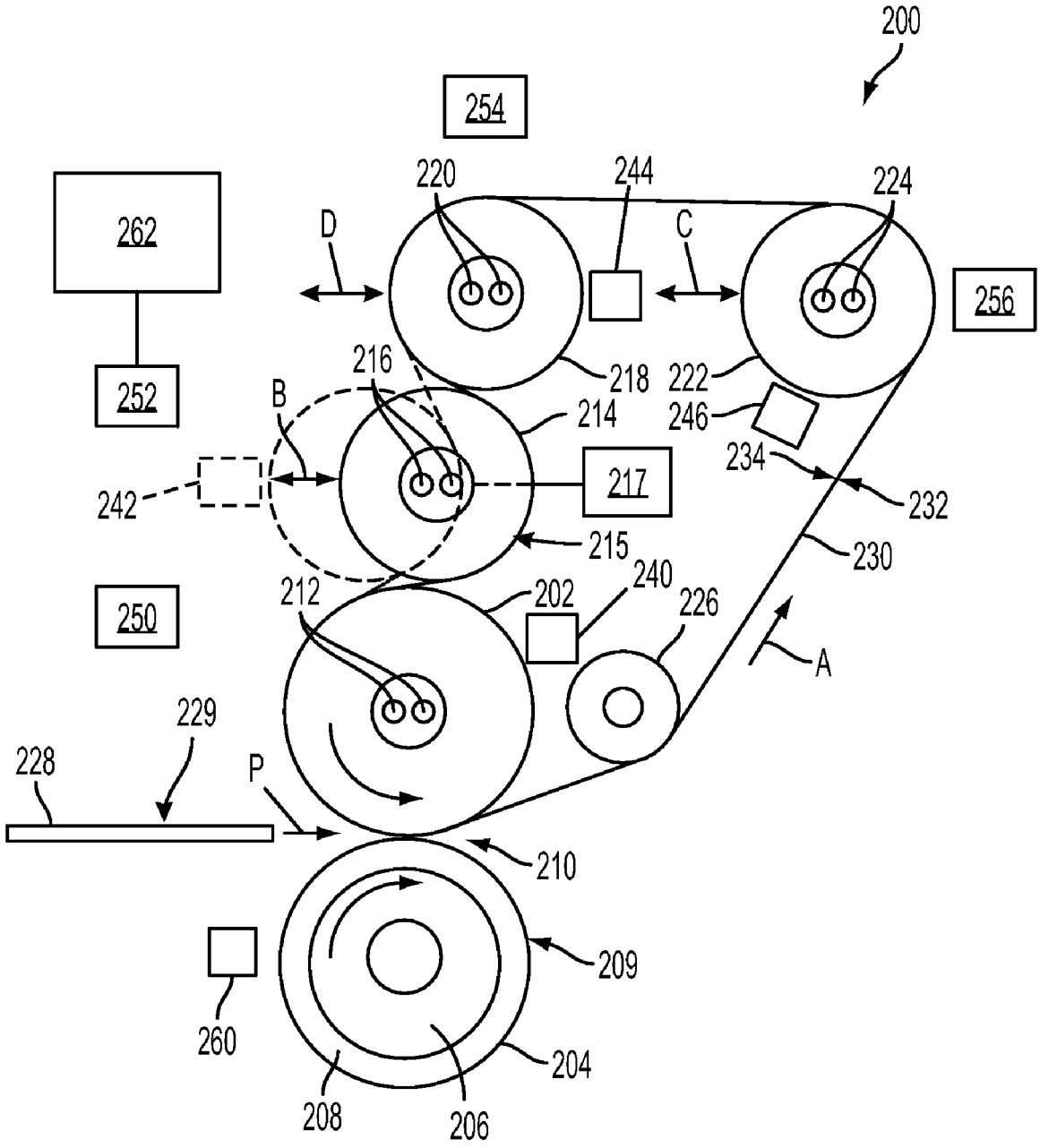
FIG. 2 illustrates an exemplary embodiment of a fuser.

FIG. 2 illustrates an exemplary embodiment of the apparatuses useful for printing. The apparatus is a fuser 200. Embodiments of the fuser 200 can be used, e.g., in different types of apparatuses that provide a print output function. For example, the fuser 200 can be used instead of the fuser 112 in the printing apparatus 100 shown in FIG. 1.

The illustrated embodiment of the fuser 200 includes an endless (continuous) belt 230 supported by a fuser roll 202, external roll 214, internal rolls 218, 222 and idler roll 226. The belt 230 includes an outer surface 232 and an opposite inner surface 234. The internal rolls 218, 222 and idler roll 226 are positioned internal to the belt 230 and contact the inner surface 234, and the external roll 214 is positioned external to the belt 220 and contacts the outer surface 232.

In embodiments, the fuser roll 202, the external roll 214 and the internal rolls 218, 222 are temperature-controlled. In the illustrated embodiment, the fuser roll 202 includes two internal heating elements 212, the external roll 214 includes two internal heating elements 216, the internal roll 218 includes two internal heating elements 220, and the internal roll 222 includes two internal heating elements 224. The heating elements 212, 216, 220 and 224 can be internal lamps, such as tungsten-quartz lamps, or the like, which extend axially in the rolls. In embodiments, the two heating elements 212 can be the same as the two heating elements 216, 220 and 224, respectively. For example, the heating elements 212, 216, 220 and 224 can each include one short heating element and one long heating element. In other embodiments, the fuser roll 202, external roll 214 and internal rolls 218, 222 can each include a single heating element (e.g., a single lamp), or more than two heating elements (e.g., three or more lamps) depending on the rated power of the heating elements. For example, the heating elements in each heated roll of fuser 200 can have a power rating of about 1 kW to about 2.5 kW.

The fuser 200 further includes a pressure roll 204 having a core 206 and an outer layer 208 overlying the core 206. The outer layer 208 includes an outer surface 209 forming a nip 210 with the outer surface 232 of the belt 230. In embodiments, the core 206 can be comprised of a rigid metallic or non-metallic material, such as aluminum, a rigid polymer, or the like, and the outer layer 208 can be comprised of an elastically deformable polymeric material having a lower coefficient of thermal conductivity than the material of the core 206. For example, the outer layer 208 can be comprised of a silicone rubber, perfluoroalkoxy (PFA) copolymer resin, or the like. The outer layer typically has a thickness of about 14 mm to about 18 mm, and a coefficient of thermal conductivity of about 0.25 W/mK to about 0.5 W/mK.

Embodiments of the belt 230 can include, e.g., a base layer, an intermediate layer on the base layer, and an outer layer on the intermediate layer. In such embodiments, the base layer forms the inner surface 234 and the outer layer forms the outer surface 232. In an exemplary embodiment of the belt 230, the base layer is comprised of a polymeric material, such as polyimide, or the like; the intermediate layer is comprised of silicone, or the like; and the outer layer is comprised of a polymeric material, such as a fluoroelastomer sold under the trademark Viton® by DuPont Performance Elastomers, L.L.C., polytetrafluoroethylene (Teflon®), or the like.

In embodiments, the belt 230 can have a thickness of, e.g., about 0.1 mm to about 0.6 mm. For example, the base layer can have a thickness of about 50 μm to about 100 μm, the intermediate layer a thickness of about 100 μm to about 500 μm, and the outer layer a thickness of about 20 μm to about 40 μm. The belt 230 can typically have a width of about 350 mm to about 450 mm, and a length of about 500 mm to at least about 1000 mm.

FIG. 2 depicts a medium 228 approaching the nip 210 in the process direction P. Marking material (e.g., toner) is present on the medium 228. In embodiments, the fuser roll 202 is rotated counter-clockwise, the pressure roll 204 is rotated clockwise and the belt 230 is rotated counter-clockwise to transport the medium 228 through the nip 210 in the process direction P. The medium 228 can be, e.g., a paper sheet, a transparency, or packaging material. Typically, paper can be classified by weight as follows: lightweight: ≦about 75 gsm, midweight: about 75 gsm to about 160 gsm, and heavyweight: ≧160 gsm. Paper sheets can be coated or uncoated. A larger amount of energy (per thickness and per basis weight) is applied to fuse toner on coated media as compared to on uncoated media.

In embodiments, the fuser 200 further includes a temperature sensor and a power supply/controller for each of the fuser roll 202, external roll 214, and internal rolls 218, 222. Temperature sensors 240, 242, 244 and 246 are positioned adjacent (as shown), or in contact with, the outer surfaces of the fuser roll 202, external roll 214 and internal rolls 218 and 222, respectively, to sense the temperatures of these surfaces. The temperature sensors 240, 242, 244 and 246 are connected in a conventional manner to a power supply/controller 250, 252, 254 and 256, respectively. The power supply/controller 250, 252, 254 and 256 are connected in a conventional manner to the heating elements 212, 216, 220 and 224, respectively. The temperature sensors 240, 242, 244 and 246 provide temperature feedback to the power supply/controller 250, 252, 254 and 256, respectively, to control the power output of the heating elements 212, 216, 220 and 224, respectively, to thereby control heating of the fuser roll 202, external roll 214 and internal rolls 218 and 222, respectively, during cold warm-up, standby and print runs. Each of the fuser roll 202, external roll 214 and internal rolls 218, 222 can be controlled to a set-point temperature.

The fuser 200 further includes a temperature sensor 260 operable to sense the temperature of the outer surface 209 of the pressure roll 204. The temperature sensor 260 can be positioned adjacent (as shown), or in contact with, the outer surface 209 of the pressure roll 204. The temperature sensor 260 can be positioned, e.g., between about a 6 o'clock position and about a 10 o'clock position about the outer surface 209 in the illustrated embodiment. The temperature sensor 260 is connected to a controller 262 in a conventional manner to provide feedback of the temperature of the outer surface 209 of the pressure roll 204.

It has been noted that in belt-type fusers that include a pressure roll having a core and an overlying, thick outer layer of silicone rubber, or the like, which forms the outer surface of the pressure roll, the pressure roll outer surface temperature can vary significantly when the fusers are used to print different media types. In such apparatuses, high pressure roll outer surface temperatures are realized with thin media, while lower temperatures are achieved with thick media and coated media. High pressure roll surface temperatures can affect duplex quality. Low pressure roll surface temperatures can adversely affect the fix of initial prints of a thin media job immediately following a long run of thick media, and when the pressure roll starts from ambient temperature (cold start).

It has further been noted that controlling the temperature of the outer surface of a pressure roll including such a thick outer layer of silicone rubber, or the like, by using direct heating is inefficient because heat has to be conducted through the thickness of the outer layer to the outer surface. When the outer layer material has significantly lower coefficients of thermal conductivity and thermal expansion than the core, thermally-induced stresses can develop inside the pressure roll that are sufficient to cause the outer layer to become delaminated from the core. In addition, after a long print job of thin media, a significant cooling air flow needs to be used to adequately cool the outer surface of the pressure roll surface in such pressure rolls.

In embodiments of the fuser 200, the temperature of the pressure roll 204 is not actively controlled. The temperature of the outer surface 209 of the pressure roll 204 is controlled by controlling the temperature of the belt 230. Heat is transferred from the heated belt 230 to the outer surface 209 of the pressure roll 204 at the nip 210. In embodiments, the fuser 200 does not include a heat source other than the belt 230 to heat the outer surface 209. In embodiments, the pressure roll 204 does not include an internal heat source in the core 206. In embodiments, the fuser 200 also does not include a cooling device (e.g., an air knife or cooling shoe) to cool the outer surface 209.

In embodiments, the length of the belt 230 contacting the outer surface 215 of the external roll 214 is adjusted based on the temperature of the pressure roll 204. For example, when the external roll 214 has a circular outer surface (as shown), the portion of the circumference of the outer surface 215 that is contacted by the belt 230 is adjusted by positioning of the external roll 214.

The contact length between the outer surface 232 of the belt 230 and the outer surface 215 of the external roll 214 in the direction of movement A of the belt 230 is referred to herein as the "wrap length." As shown in FIG. 2, the wrap length is adjusted by moving the external roll 214 relative to the belt 230 as depicted by arrows B. As shown, this movement is approximately perpendicular to the direction of movement of the belt 230 over the outer surface 215 of the external roll 214 (i.e., approximately perpendicular to the process direction). Moving the external roll 214 away from the belt 230 to the position depicted in broken line (i.e., to the left in FIG. 2, or "out") decreases the wrap length, while moving the external roll 214 toward the belt 230 (i.e., to the right in FIG. 2, or "in") increases the wrap length. At a given power output of the heating elements 216, increasing the wrap length of the belt 230 increases heating of the belt 230 by increasing the amount of heat transfer from the external roll 214 to the belt 230 due to the increased amount of time (i.e., contact time) that the belt 230 contacts the outer surface 215.

In embodiments, the wrap length of the belt 230 can be adjusted in a continuous manner during print runs. In an exemplary embodiment, the temperature sensor 260 continuously monitors the temperature of the outer surface 209 during a print run, and based on temperature feedback from the temperature sensor 260, the external roll 214 is kept at its current position (to maintain the current wrap length) when the feedback temperature equals a desired temperature, or varies from the desired temperature by, e.g., less than ±2° C. When the temperature of the outer surface 209 is below the desired temperature (e.g., at the beginning of a print run), the external roll 214 is moved "in" along direction B to increase the wrap length so as to increase heating of the belt 230. When the temperature of the outer surface 209 exceeds the desired temperature, the external roll 214 is moved "out" as depicted by arrow B to decrease the wrap length so as to decrease heating of the belt 230.

In embodiments, the wrap length that achieves a desired temperature of the belt 230 depends on various factors including, e.g., the power rating of the heating elements 212, 220 and 224; the power rating of the heating elements 216 in the external roll 214, the thickness and thermal conductivity of the belt 230, and the thickness of the media run in the fuser 200.

The marking material-medium (e.g., toner-paper) interface temperature is the temperature at the interface between the surface of a medium that contacts the belt 230 and marking material on the surface. In the illustrated embodiment, the surface 229 of the medium 228 is contacted by the belt 230 at the nip 210. The temperature sensor 260 senses the temperature of the outer surface 209 of the pressure roll 204. The temperature of the outer surface 209 differs from the marking material-medium interface temperature. The marking material-medium interface temperature is lower than the temperature of the belt 230. The outer surface 209 has a lower temperature than the belt 230 because the outer surface 209 is heated by the belt 230 only in the inter-document zone at the nip 210.

The temperature of the outer surface 209 of the pressure roll 204 affects the marking material-medium interface temperature. This effect is larger for thin (lightweight) media due to the rate of heat transfer from the bottom side of the paper to the top surface. It has been determined that the marking material-medium interface temperature is substantially independent of the temperature of the outer surface 209 of the pressure roll 204 for thick media (i.e., heavy-weight media). For such thick media, a desired marking material-medium interface temperature can be maintained without changing the wrap length even as the temperature of the outer surface 209 of the pressure roll 204 changes during print runs.

In embodiments, the temperature of the outer surface 209 of the pressure roll 204 is measured due to the outer layer 208 having a low thermal conductivity. Consequently, the outer layer 208 provides resistance to heat transfer from the outer surface 209 to the core 206, and vice versa. At the start of a print job, when the pressure roll 204 is cold, the wrap length of the belt 230 on the external roll 214 can be increased to compensate for the cold pressure roll 204 and reach the desired marking material-medium interface temperature. This technique of heating the pressure roll with the belt 230 is more efficient than actively heating the cold pressure roll 204 to the desired temperature prior to the start of the print job using an internal heat source. Such active heating would typically take a significant amount of time, e.g., about 15 min., due to the thickness and low thermal conductivity of the outer layer 208. In contrast, engaging the pressure roll 204 to the belt 230 while the whole fuser 200 warms up will slow down the warm-up of the fuser 200 by an estimated amount of time of only about 1 min. to about 2 min. Moreover, in embodiments of the fuser 200, a print job can start with the pressure roll 204 at ambient temperature, which eliminates any time overhead to the warm-up of the fuser 200. Also, as a print job progresses, the outer surface 209 of the pressure roll 204, which is continuously heated by the belt 230 at the nip 210, becomes increasingly hotter. Because the temperature of the belt 230 is changed to compensate for the hot pressure roll 204, the pressure roll 204 does not need to be actively cooled, such as by using an added cooling device, such as an air-knife, cooling shoe, or the like. Accordingly, by controlling the set point temperature of the belt 230 by changing the wrap length to compensate for changes in the temperature of the pressure roll 204 throughout a print job, the temperature of the pressure roll 204 does not need to be controlled without the use of less-efficient active heating devices and cooling devices in the fuser 200.

In embodiments, the temperature sensor 260 senses the temperature of the outer surface 209 of the pressure roll 204, and the wrap length of the belt 230 on the external roll 214 is adjusted based on the sensed temperature to control the marking material-medium interface temperature. Combining temperature feedback with adjustment of the wrap length of the belt 230 in the fuser 200 allows a stable marking material-medium interface temperature (target temperature) to be maintained throughout a print job for different media types. Different media types can include lightweight coated paper, medium-weight coated paper, heavy-weight coated paper, lightweight uncoated paper, medium-weight uncoated paper, heavy-weight uncoated paper, transparencies, and packaging materials. A stable marking material-medium interface temperature can be achieved for all media types under different process conditions, such as when the pressure roll 204 is initially at ambient temperature at the beginning of the print job. In addition, by not actively heating the pressure roll 204, the fuser 200 eliminates the need to warm up the pressure roll 204 before a print run, which significantly reduces the warm-up time of the unit.

In embodiments, the external roll 214 is moved in and out, as indicated by arrows B, relative to the belt 230 by a positioning device 217 coupled to the external roll 214. The positioning device 217 can be any suitable self-compensating mechanism that provides the desired range of motion and response time. For example, the positioning device 217 can include a pneumatic cylinder, a solenoid, or the like, coupled to the external roll 214. In embodiments, the positioning device 217 can provide a range of motion of approximately the diameter of the external roll 214, and a response time of about 1 to about 2 seconds. The positioning device 217 is connected in a conventional manner to the controller 262 to allow the position of the external roll 214 and the corresponding wrap length of the belt 230 to be adjusted based on the temperature of the outer surface 209 of the pressure roll 204, as determined by the temperature sensor 260.

Each of the fuser roll 202, the external roll 214 and internal rolls 218, 222 has a respective temperature set-point, which is independent of the temperature of the pressure roll 204. The variable amount of heating of the belt 230 to achieve a constant marking material-medium interface temperature during a print job is achieved by changing the wrap length of the belt 230 on the external roll 214.

In embodiments, the position of the internal roll 218 and/or the internal roll 222 can be adjusted to change the tension in the belt 230 when the external roll 214 is re-positioned. In embodiments, the mechanism(s) used to adjust the positions of the internal roll 218 and/or the internal roll 222 can be connected to the controller 262 to allow the internal roll 218 and/or the internal roll 222 to be moved in unison with the external roll 214 to maintain the desired tension of the belt 230. In this manner, the tension of the belt 230 can be maintained at about a selected value, or within a selected range. For example, when the external roll 214 is moved in, the internal roll 222 can be moved to the left in the direction depicted by arrow C. When the external roll 214 is moved out, the internal roll 222 can be moved to the right in the direction depicted by arrow C, to maintain the desired tension in the belt 230. Alternatively, when the external roll 214 is moved in, the internal roll 218 can be moved to the right in the direction depicted by arrow D. When the external roll 214 is moved out, the internal roll 218 can be moved to the left in the direction depicted by arrow D, to maintain the desired tension in the belt 230.

In embodiments, the effect of the wrap length of the belt 230 on the external roll 214 is significantly greater than the effect of changing the wrap length of the belt 230 on the internal roll 218 or internal roll 222. First, the external roll 214 contacts the outer surface 232 of the belt 230 and also is located closer to the nip 210. Second, the change in wrap length of the belt 230 on the internal roll 218 or internal roll 222 is normally significantly less than the change in the wrap length of the belt 230 due to movement of the external roll 214.

Based on the results of a three-dimensional heat transfer model for the marking material-medium interface temperature versus wrap length at different pressure roll surface temperatures for a selected type of medium, a linear transfer function that relates the wrap length (WL) to the pressure roll temperature (T) to achieve a selected marking material-medium interface temperature throughout a print job for the medium can be determined. When WL is plotted on the y-axis and T on the x-axis, the transfer function has the form: $WL=(C_1 \cdot T)+C_2$, where $C_1$ and $C_2$ are the slope and y-intercept, respectively. Transfer functions can be developed for different media weights, marking material-medium interface temperatures, and apparatus architectures. Such transfer functions will be linear and have different values of the slope and y-intercept.

In an exemplary embodiment using the fuser 200, the wrap length of the belt 230 on the external roll 214 is adjusted according to the following procedure. The external roll 214 is set to a lower standby temperature, e.g., 190° C. A short warm-up time is used before the start of the print job to raise the temperature of the external roll 214 to the desired temperature, e.g., 225° C. During the warm-up period, the pressure roll 204 is engaged with the belt 230 at the nip 210 to prevent the belt 230 from being heated to above a maximum temperature. At the start of the print job, when the outer surface 209 of the pressure roll 204 is at a low temperature, the wrap length is highest. As the temperature of the outer surface 209 increases, the wrap length is decreased. A transfer function (of the form described above) that correlates the wrap length to the temperature of the outer surface 209 for the media type being printed is used to adjust the wrap length during the print job. When the wrap length is changed during a print run by moving the external roll 214, the tension in the belt 230 can be adjusted by moving the internal roll 218 and/or the internal roll 222.

In other embodiments, the wrap length is changed after a selected number of prints have been run, which affects the temperature of the outer surface 209. For example, the wrap length can be changed in a step-wise manner every 25, 50, 100, 200 or 250 prints by measuring the pressure roll temperature after each increment and outputting temperature feedback to the controller 262 to adjust the wrap length accordingly before the next increment of prints is run. Changing the wrap length in a more continuous manner (i.e., at a higher frequency, such as after every 25 or 50 prints versus every 250 prints) is expected to decrease variation between the marking material-medium interface temperature and the target temperature.

EXAMPLES

In FIGS. 3 to 8, the following abbreviations are used: "FR" is a fuser roll, "ER" is an external roll, "M-M interface temperature" is the marking material-media interface temperature, "PR" is a pressure roll, "IR-1" is a first internal roll, "IR-2" is a second internal roll, and "belt" is a fuser belt.

Figure 3:
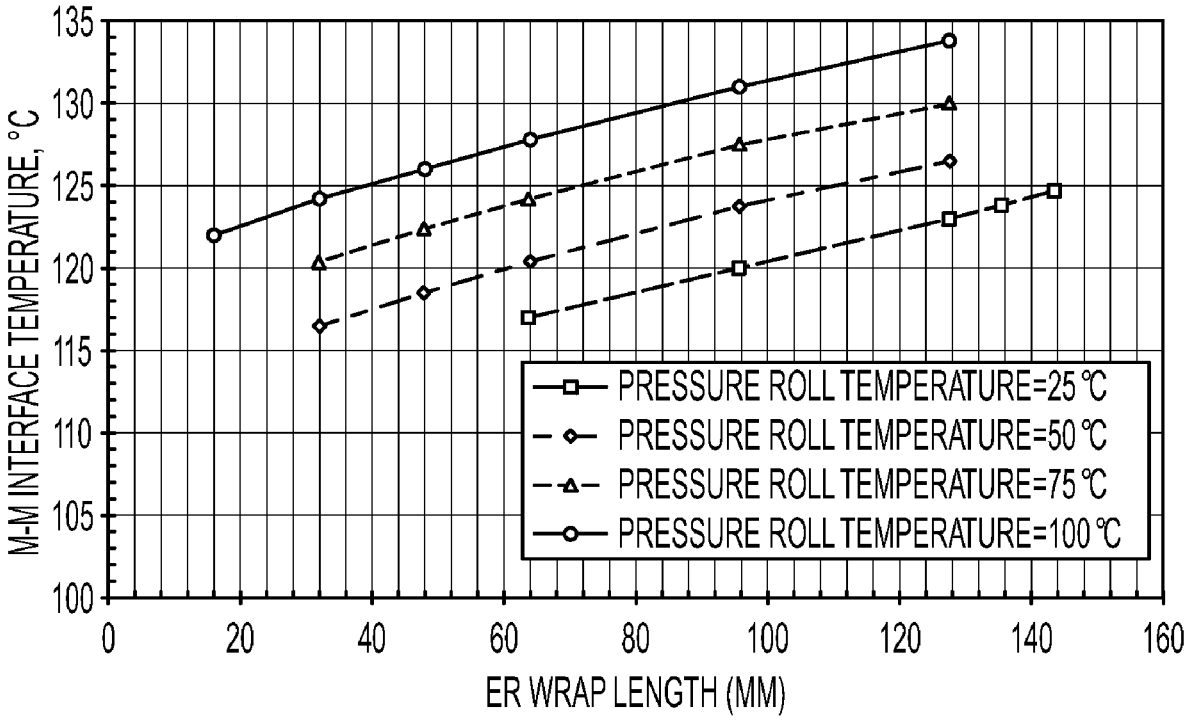
FIG. 3 depicts modeled plots for marking material-media (M-M) interface temperature versus external roll (ER) wrap length of a belt at different pressure roll temperatures.

FIG. 3 shows plots of the steady-state T-P interface temperature as a function of the external roll wrap length of the belt at different pressure roll outer surface temperatures of 25° C., 50° C., 75° C. and 100° C. The plots were developed by running numerical simulations of the architecture of the fuser 200 depicted in FIG. 2, using a three-dimensional heat transfer analysis code. In the simulations, the "external roll" is the external roll 214, the "wrap length" is the wrap length of the belt 230 on the outer surface 209 of the external roll 214, and the "pressure roll" is the pressure roll 204. In the simulations, the external roll 214 was maintained at a temperature of 225° C., the internal rolls 218, 222 and the fuser roll 202 were maintained at a temperature of 190° C., and the medium was 60 gsm paper (lightweight paper).

As indicated in FIG. 3, as the pressure roll temperature is increased from 25° C. to 50° C., from 50° C. to 75° C., and from 75° C. to 100° C., the external roll wrap length that achieves a given marking material-media interface temperature decreases. For example, for a steady-state marking material-media interface temperature of 125° C., at pressure roll temperatures of 25° C., 50° C., 75° C. and 100° C., the external roll wrap length is about 144 mm, about 112 mm, about 72 mm, and about 40 mm, respectively.

Figure 4:
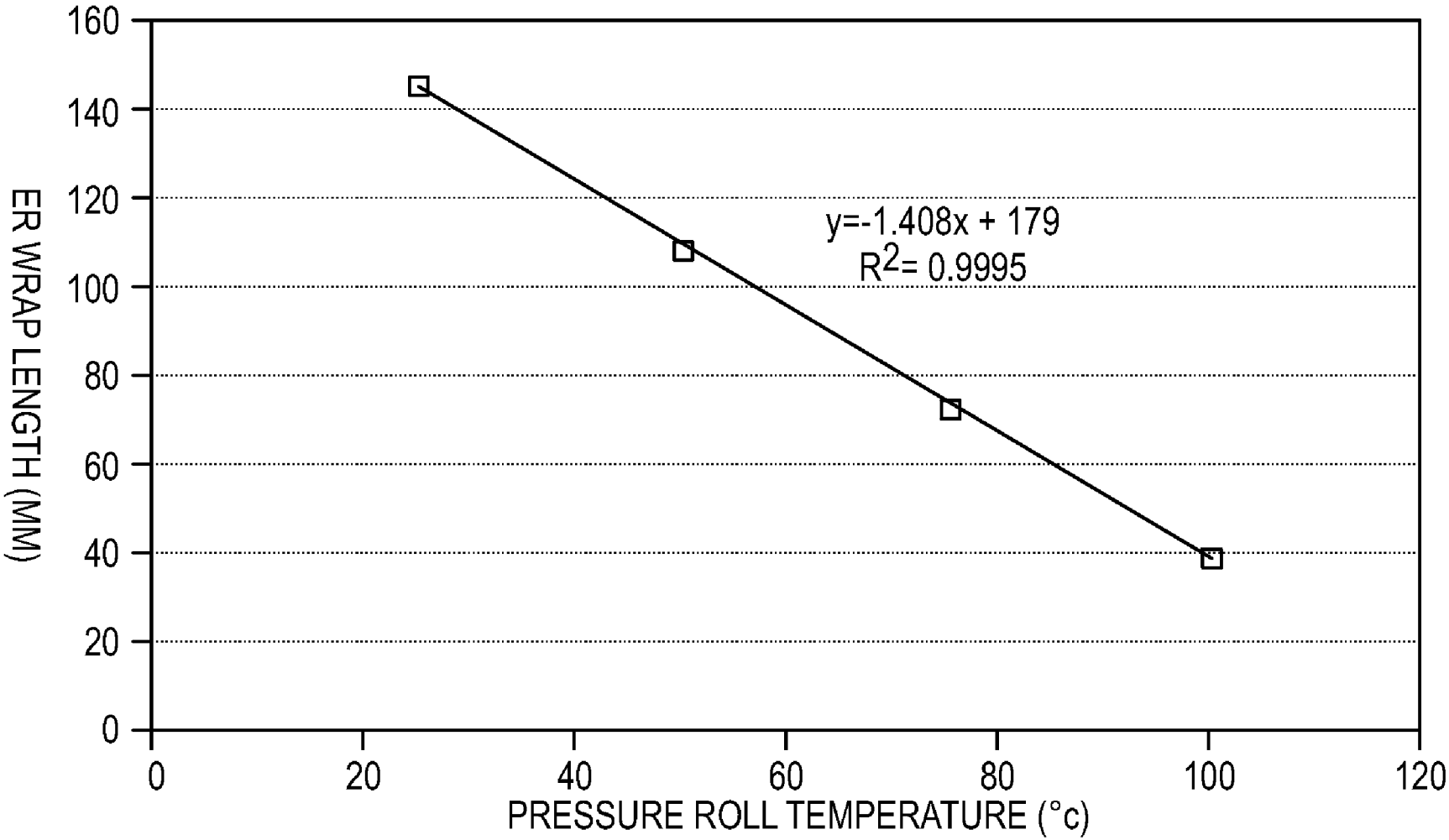
FIG. 4 depicts a plot of external roll wrap length as a function of pressure roll temperature to achieve a marking material-paper interface temperature of 125° C. for a 60 gsm media weight.

Based on the plots in FIG. 3, a linear transfer function that relates the wrap length (WL) to the pressure roll temperature (T) to achieve a toner-paper interface temperature of 125° C. throughout a print job for 60 gsm paper is determined by plotting WL as a function of T. As depicted in FIG. 4, this relationship is expressed as Equation (1):

$$WL(\text{mm})=(-1.408\cdot T(^\circ\text{ C.}))+179, \text{ where } -1.408 \text{ and } 179 \text{ are the slope and y-intercept, respectively.} \quad (1)$$

Figure 5A:
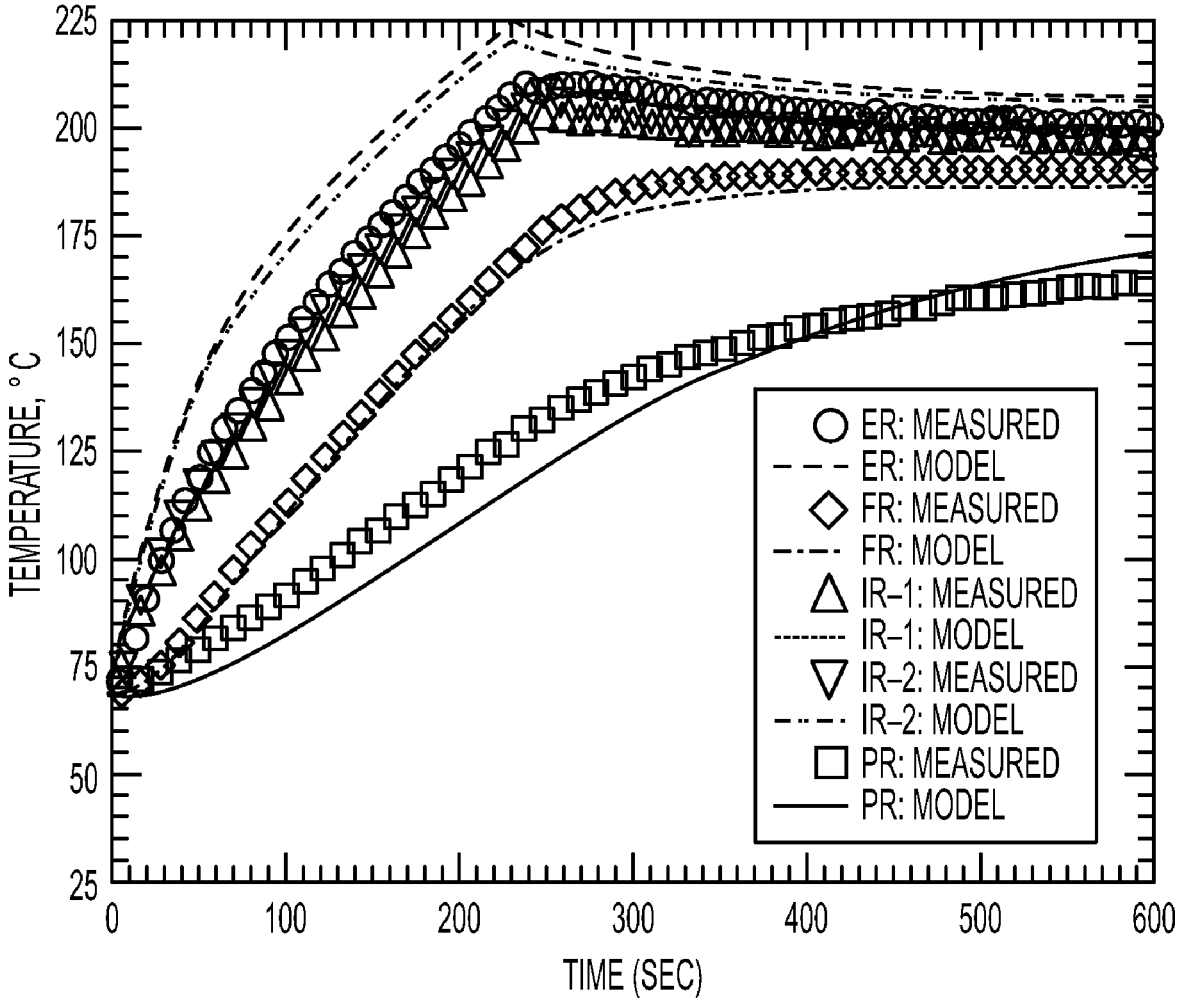
FIG. 5A depicts measured and modeled surface temperature versus time plots for an external roll, fuser roll (FR), first internal roll (IR-1), second internal roll (IR-2) and a pressure roll (PR) of a fuser during warm-up of the fuser.

FIG. 5A depicts measured and modeled surface temperature versus time plots for an external roll, fuser roll, first internal roll, second internal roll and pressure roll of a fuser, which correspond to the external roll 214, fuser roll 202, internal roll 222, internal roll 218 and pressure roll 204, respectively, shown in FIG. 2. In this example and simulation, the fuser roll, first and second internal rolls and external roll each included a long, 1.5 kW heating lamp. The pressure roll was engaged to the belt and was not actively cooled. The plots in FIG. 5A show a close correspondence between the modeled and measured values for each roll.

Figure 5B:
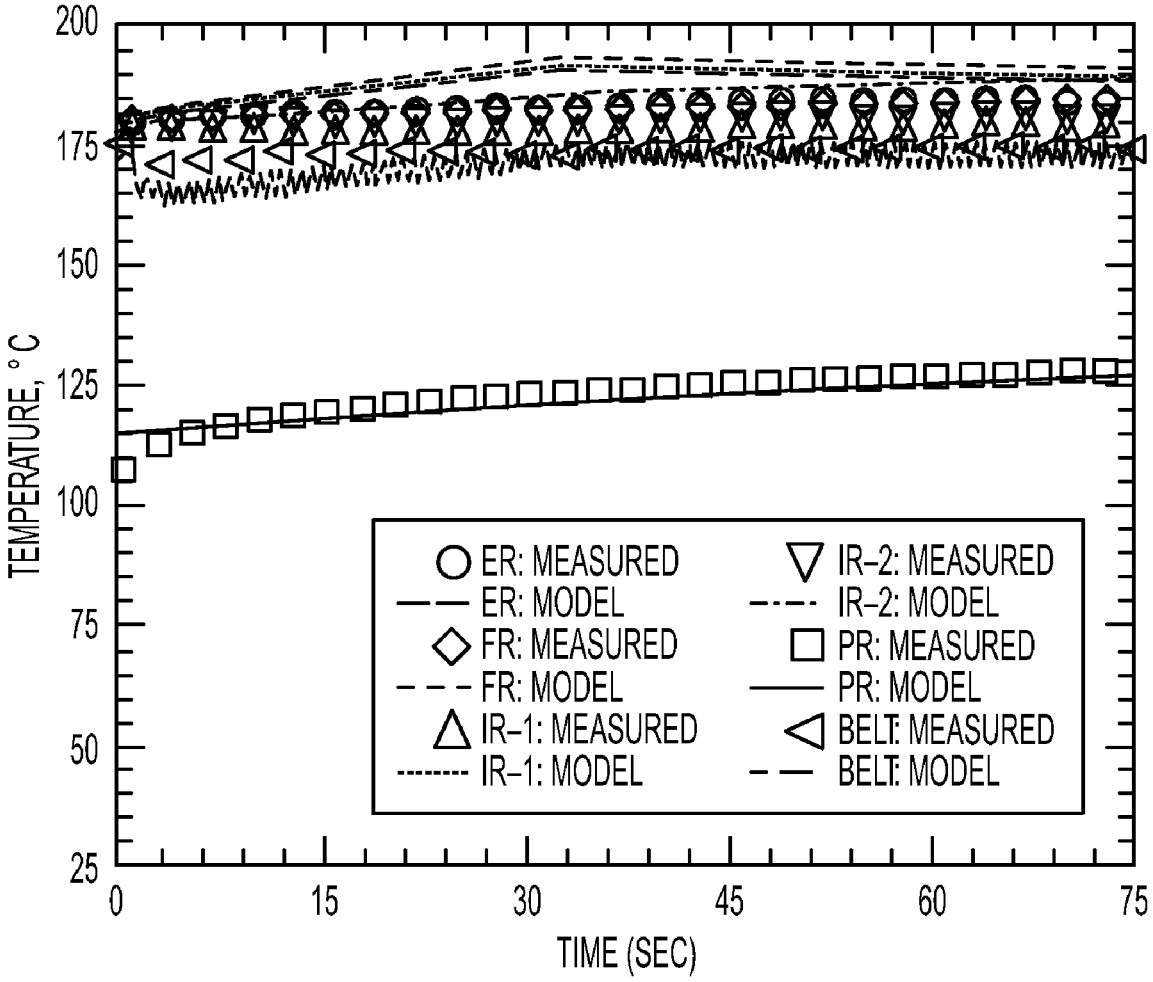
FIG. 5B depicts measured and modeled surface temperature versus time plots for an external roll, fuser roll, first internal roll, second internal roll, pressure roll and belt of a fuser during a 100 page print job using 120 gsm paper.

FIG. 5B depicts measured and modeled plots for surface temperature as a function of time for an external roll, fuser roll, first internal roll, second internal roll, pressure roll and fuser belt for the fuser architecture shown in FIG. 2, resulting from making 100 prints using 120 gsm coated paper and the same heating conditions used to generate the plots shown in FIG. 5A. The plots in FIG. 5B show close correspondence between the modeled and measured values for each of the external roll, fuser roll, first internal roll, second internal roll, pressure roll and belt.

Figure 6:
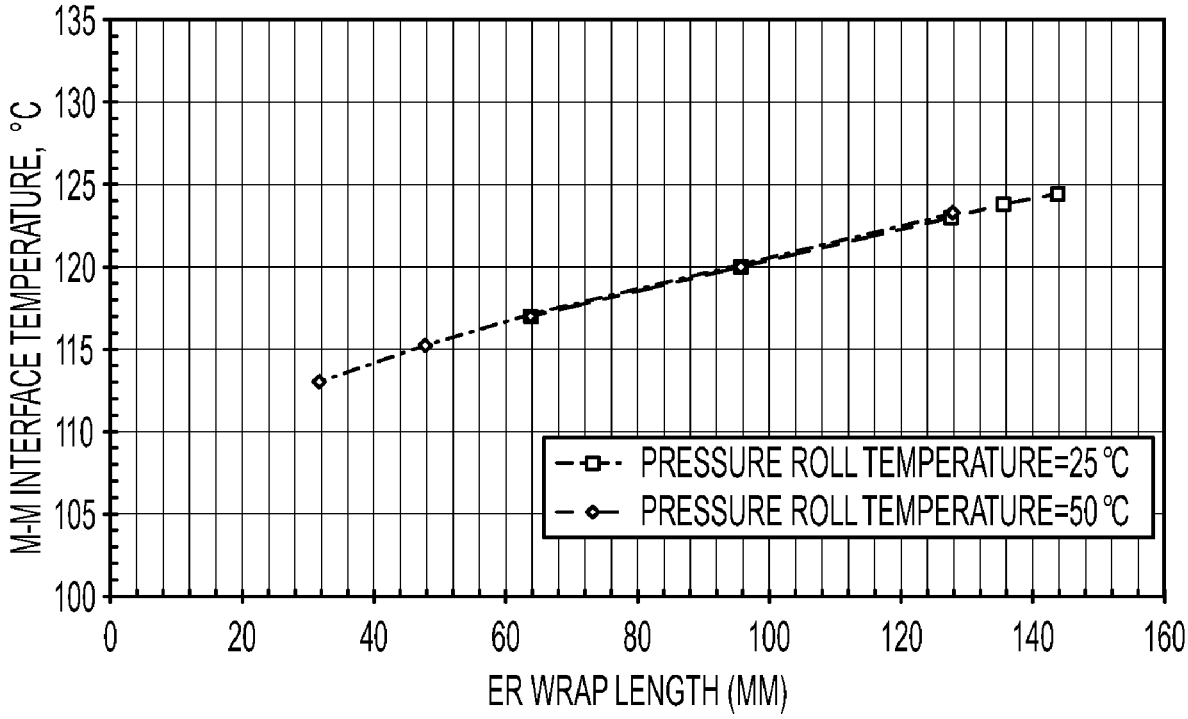
FIG. 6 depicts plots for the marking material-paper interface temperature versus external roll wrap length for thick media (350 gsm) at pressure roll temperatures of 25° C. and 50° C.

FIG. 6 depicts plots for the steady-state marking material-media interface temperature as a function of the external roll wrap length at pressure roll outer surface temperatures of 25° C. and 50° C. for 350 gsm paper. The plots were developed by modeling using the fuser architecture shown in FIG. 2. As shown in FIG. 6, for thick media, the interface temperature is essentially independent of the pressure roll temperature.

Figure 7:
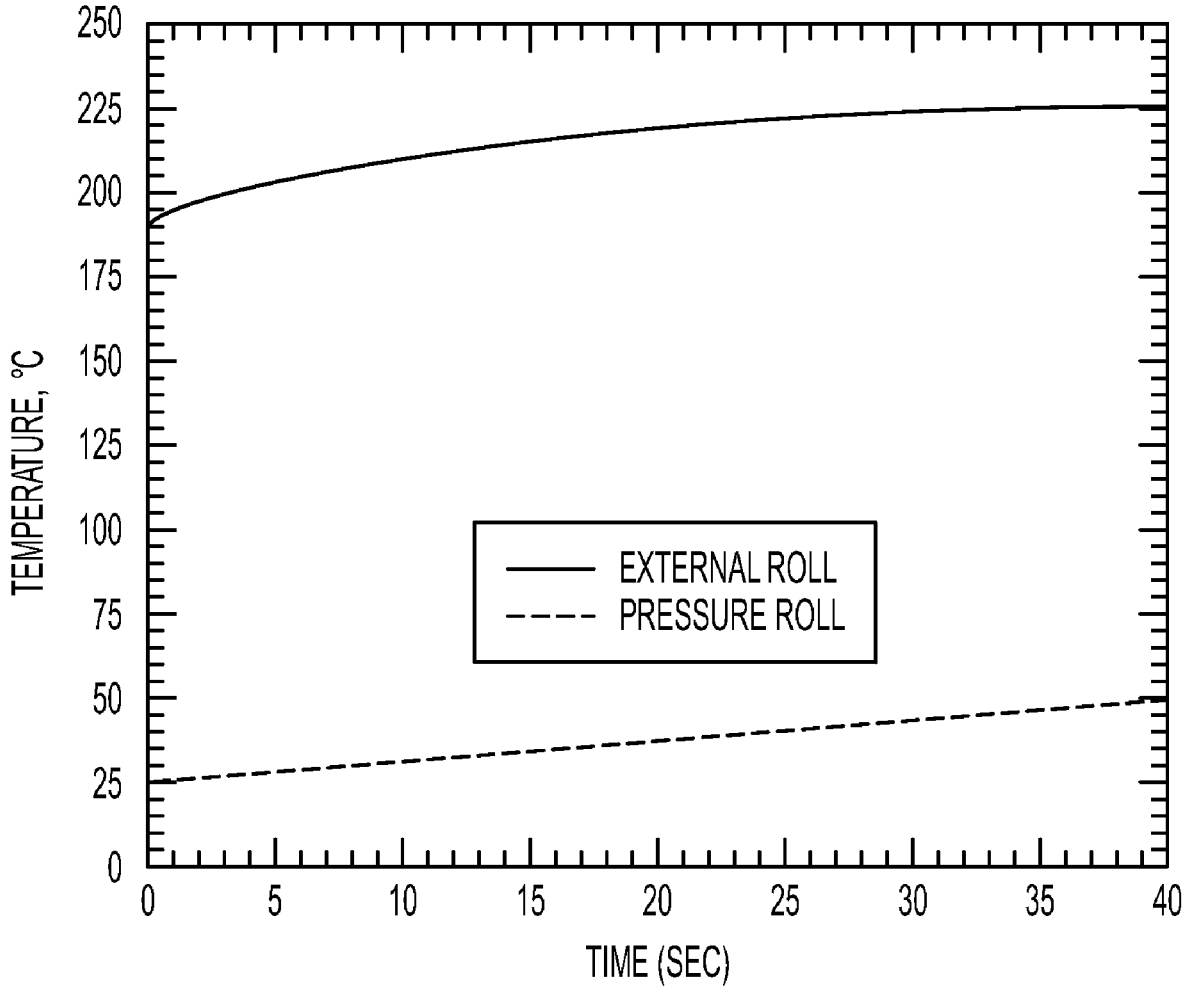
FIG. 7 depicts temperature versus time plots for an external roll and a pressure roll.

FIG. 7 depicts simulated plots of the outer surface temperature as a function of time for an external roll and a pressure roll in the fuser architecture shown in FIG. 2. At the beginning of the simulation, the belt and external roll are at a standby temperature of 190° C. and the pressure roll is at a cold temperature of 25° C. The external roll is then heated to a temperature of 225° C. with the pressure roll engaged with the belt. As shown in FIG. 7, the external roll is heated from the standby temperature of 190° C. to a temperature of 225° C. in about 30 to 40 seconds. At the end of the warm-up period, the pressure roll temperature is 50° C.

Figure 8:
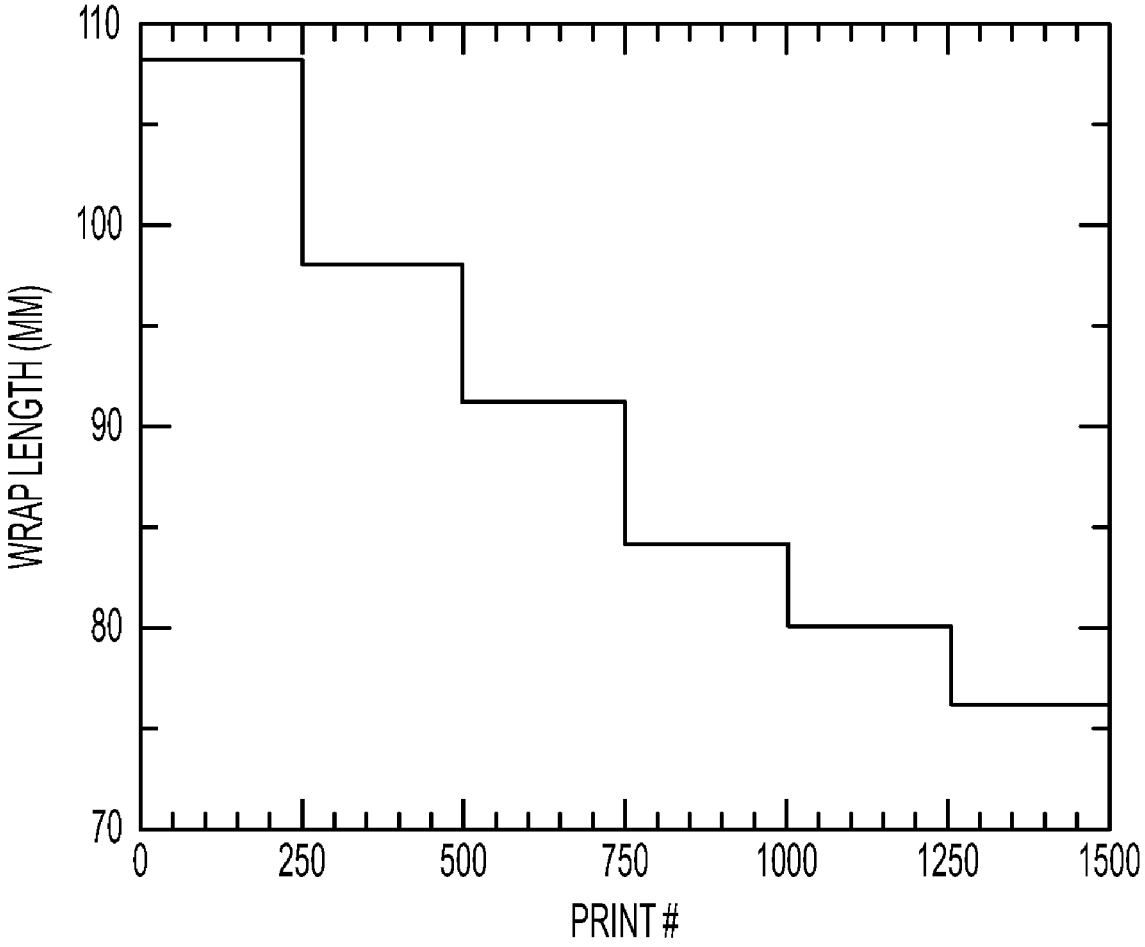
FIG. 8 depicts a step-wise variation in external roll wrap length of a belt as a function of print number for a fuser.

Then, a print job of 1500 prints using 60 gsm paper is simulated. As shown in FIG. 8, the wrap length of the belt on the external roll is changed (decreased) during the print job every other 250 prints using the relationship between the wrap length and pressure roll temperature in Equation (1). During the simulation, the wrap length is specified at the beginning of each 250 print run, based on the temperature of the pressure roll at the end of the previous 250 print run, and the wrap length is unchanged throughout each 250 print run. The simulation is then restarted using the conditions of the previous 250 print run as the initial conditions for the next 250 print run.

Figure 9:
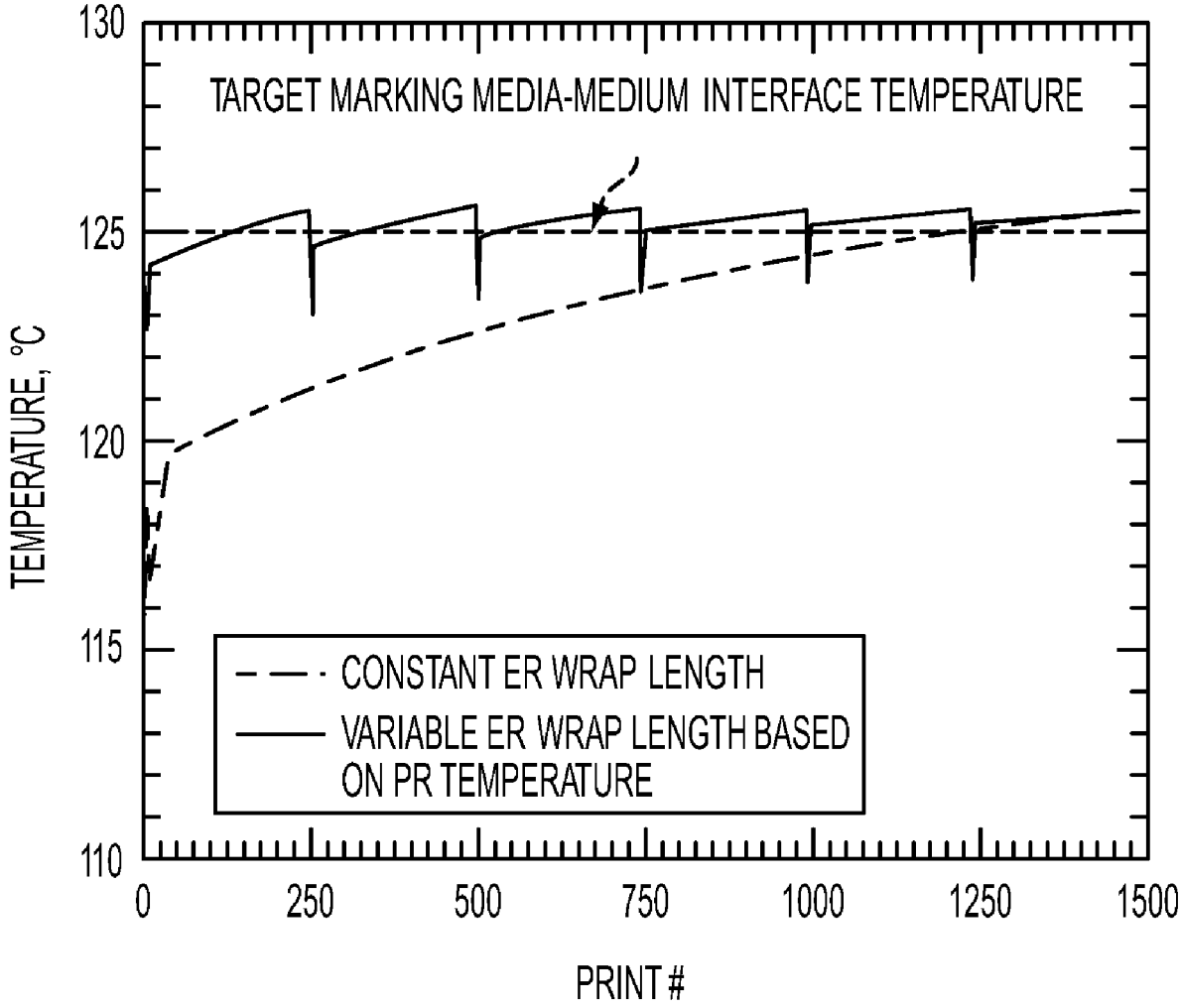
FIG. 9 depicts marking material-media interface temperature versus print number plots for a constant external roll wrap length and a variable external roll wrap length of a belt based on the pressure roll temperature.

FIG. 9 depicts plots of the marking material-paper interface temperature as a function of the print number resulting from changing the wrap length every other 250 prints. FIG. 9 also shows the marking material-paper interface temperature as a function of print number when the pressure roll starts from a cold temperature and the wrap length is not changed during the print job. The target marking material-paper interface temperature of 125° C. is also shown.

As shown in FIG. 9, in the case in which the wrap length is kept constant during the print job, the target marking material-paper interface temperature of 125° C. is not achieved until 1300 prints have been run. As also shown, in this case, the initial prints have a marking material-paper interface temperature that is up to about 10° C. lower than the target temperature.

As further shown in FIG. 9, in contrast, the described method achieves a more uniform marking material-paper interface temperature throughout the print job, even when the pressure roll starts from a cold temperature. The only variations from the target temperature are at the beginning of each 250 print run, and these variations have a magnitude of not more than 2° C.

Although the above description is directed toward fuser apparatuses useful in xerographic printing, it will be understood that the teachings and claims herein can be applied to any treatment of marking material on a medium. For example, the marking material can be comprised of toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:
- a heating first roll including a first outer surface;
- a heating second roll including a second outer surface;
- a third roll including a third outer surface;
- a temperature sensor for sensing the temperature of the third outer surface;
- a belt supported on the first roll and the second roll and disposed between the first outer surface and the third outer surface, the belt including an inner surface and an outer surface;
- a nip between the third outer surface and the outer surface of the belt at which the belt heats media which include a surface, marking material on the surface and an interface between the surface and the marking material; and
- a positioning device coupled to the second roll, the positioning device being operable to move the second roll relative to the outer surface of the belt to change a wrap length of the belt on the second outer surface, based on the temperature of the third outer surface, to maintain a substantially constant temperature at the interface between the surface and the marking material.

2. The apparatus of claim 1, wherein:
- the first outer surface contacts the inner surface of the belt;
- the second outer surface and the third outer surface contact the outer surface of the belt; and
- the positioning device is operable to (i) move the second roll toward the belt in a first direction, which is substantially perpendicular to a process direction of the belt, to increase the wrap length of the belt on the second outer surface to thereby increase the temperature of the outer surface of the belt, and (ii) move the second roll away from the belt in a second direction, which is opposite to the first direction and substantially perpendicular to the process direction of the belt, to decrease the wrap length of the belt on the second outer surface to thereby decrease the temperature of the outer surface of the belt, based on the temperature of the third outer surface.

3. The apparatus of claim 1, further comprising a controller connected to the temperature sensor and the positioning device, wherein the controller receives signals from the temperature sensor and controls the positioning device to move the second roll toward or away from the outer surface of the belt to change the wrap length of the belt on the second outer surface based on the sensed temperature of the third outer surface.

4. The apparatus of claim 1, wherein the third roll comprises an elastically deformable polymer including the third outer surface.

5. The apparatus of claim 1, further comprising:
- a heated fourth roll including a fourth outer surface contacting the inner surface of the belt; and
- a heated fifth roll including a fifth outer surface contacting the inner surface of the belt;
- wherein at least one of the fourth roll and fifth roll is movable relative to the inner surface of the belt to change the tension in the belt.

6. The apparatus of claim 1, wherein the third roll is not internally heated.

7. The apparatus of claim 1, wherein:
- the belt is a continuous fuser belt;
- the first roll is a fuser roll disposed internal to the fuser belt;
- the second roll is disposed external to the fuser belt; and
- the third roll is an external pressure roll comprising an elastically deformable polymer including the third outer surface.

8. An apparatus useful for printing, comprising:
- a heating first roll including a first outer surface;
- a heating second roll including a second outer surface;
- a third roll including a third outer surface;
- a first temperature sensor for sensing the temperature of the third outer surface;
- a continuous belt disposed between the first outer surface and the third outer surface, the belt including an inner surface which contacts the first outer surface and an outer surface which contacts the second outer surface and the third outer surface;
- a nip between the third outer surface and the outer surface of the belt at which the belt heats media which include a surface, marking material on the surface and an interface between the surface and the marking material;
- a positioning device coupled to the second roll, the positioning device being operable to move the second roll relative to the outer surface of the belt to change a wrap length of the belt on the second outer surface; and
- a first controller connected to the first temperature sensor and the positioning device;
- wherein the first controller receives signals from the first temperature sensor and controls the positioning device to move the second roll toward or away from the outer surface of the belt to change the wrap length of the belt on the second outer surface, based on the temperature of the third outer surface, to maintain a substantially constant temperature at the interface between the surface and the marking material.

9. The apparatus of claim 8, wherein the positioning device is operable to (i) move the second roll toward the belt in a first direction, which is substantially perpendicular to a process direction of the belt, to increase the wrap length of the belt on the second outer surface and increase the temperature of the outer surface of the belt, and (ii) move the second roll away from the belt in a second direction, which is opposite to the first direction and substantially perpendicular to the process direction of the belt, to decrease the wrap length of the belt on the second outer surface and decrease the temperature of the outer surface of the belt, based on the temperature of the third outer surface.

10. The apparatus of claim 8, further comprising:

at least one first heating element for heating the first outer surface;

a second temperature sensor for sensing the temperature of the first outer surface;

a first power supply connected to each first heating element;

a second controller connected to the first power supply;

at least one second heating element for heating the second outer surface;

a third temperature sensor for sensing the temperature of the second outer surface;

a second power supply connected to each second heating element; and a third controller connected to the second power supply;

wherein the second controller controls the first power supply to control an amount of power supplied by each first heating element to achieve a first temperature set point for the first outer surface; and wherein the third controller controls the second power supply to control an amount of power supplied by each second heating element to achieve a second temperature set point for the second outer surface.

11. The apparatus of claim 10, further comprising:

a fourth roll including a fourth outer surface contacting the inner surface of the belt and at least one third heating element for heating the fourth outer surface;

a fourth temperature sensor for sensing the temperature of the fourth outer surface;

a third power supply connected to each third heating element;

a fourth controller connected to the third power supply;

a fifth roll including a fifth outer surface contacting the inner surface of the belt and at least one fourth heating element for heating the fifth outer surface;

a fifth temperature sensor for sensing the temperature of the fifth outer surface;

a fourth power supply connected to each fourth heating element;

a fifth controller connected to the fourth power supply;

wherein the fourth controller controls the third power supply to control an amount of power supplied by each third heating element to achieve a third temperature set point for the fourth outer surface; and wherein the fifth controller controls the fourth power supply to control an amount of power supplied by each fourth heating element to achieve a fourth temperature set point for the fifth outer surface.

12. The apparatus of claim 8, further comprising:

a heated fourth roll including a fourth outer surface contacting the inner surface of the belt; and a heated fifth roll including a fifth outer surface contacting the inner surface of the belt;

wherein at least one of the fourth roll and the fifth roll is movable relative to the inner surface of the belt to adjust the tension in the belt.

13. The apparatus of claim 8, wherein:

the third roll comprises an elastically deformable polymer including the third outer surface; and the third roll is not internally heated.

14. A printing apparatus comprising the apparatus of claim 8, wherein:

the first roll is a fuser roll;

the third roll is an external pressure roll comprising an elastically deformable polymer including the third outer surface; and the belt is a continuous fuser belt.

15. A method of controlling the temperature at an interface between a surface and marking material on the surface of media in an apparatus useful for printing, the apparatus comprising a heating first roll including a first outer surface, a heating second roll including a second outer surface, a third roll including a third outer surface, and a belt contacting the first roll and second roll and disposed between the first outer surface and the third outer surface, the belt including an inner surface and an outer surface, the third outer surface and the outer surface of the belt forming a nip, the method comprising:

feeding a first medium of a first media type to the nip, wherein the first medium includes a first surface, a first marking material on the first surface and a first interface between the first surface and the first marking material;

sensing the temperature of the third outer surface; and controlling a wrap length of the belt on the second outer surface, based on the temperature of the third outer surface, to maintain a substantially constant temperature at the first interface between the first surface and the first marking material of the first medium.

16. The method of claim 15, wherein:

the first outer surface contacts the inner surface of the belt;

the second outer surface and the third outer surface contact the outer surface of the belt; and the controlling of the wrap length of the belt on the second outer surface comprises at least one of (i) moving the second roll toward the belt in a first direction, which is substantially perpendicular to a process direction of the belt, to increase the wrap length of the belt on the second outer surface to thereby increase the temperature of the outer surface of the belt, and (ii) moving the second roll away from the belt in a second direction, which is opposite to the first direction and substantially perpendicular to the process direction of the belt, to decrease the wrap length of the belt on the second outer surface to thereby decrease the temperature of the outer surface of the belt.

17. The method of claim 16, wherein:

the apparatus further comprises:

a heated fourth roll including a fourth outer surface contacting the inner surface of the belt; and a heated fifth roll including a fifth outer surface contacting the inner surface of the belt; and the method further comprises moving at least one of the fourth roll and fifth roll relative to the inner surface of the belt to maintain the tension in the belt when the second roll is moved in the first direction or second direction relative to the belt.

18. The method of claim 15, wherein:

the third roll comprises an elastically deformable polymer including the third outer surface; and the third roll is heated externally only by contact with the belt, and is not internally or externally cooled.

19. The method of claim 15, further comprising:

determining a first relationship between the temperature at the first interface of the first media type and the wrap length of the belt on the second outer surface for a first temperature of the third outer surface;

determining a second relationship between the temperature at the first interface of the first media and the wrap length of the belt on the second outer surface for a second temperature of the third outer surface;

determining a first transfer function relating the wrap length (WL) of the fuser belt on the second outer surface to the temperature (T) of the third outer surface, for a first value of the temperature at the first interface, using the first relationship and the second relationship, as follows: $WL=(C_1 \cdot T)+C_2$, where $C_1$ is the slope and $C_2$ is the y-intercept; and applying the first transfer function to control the wrap length of the belt on the second outer surface to achieve the first value of the temperature at the first interface for the first media type.

20. The method of claim 15, further comprising:

feeding a second medium of a second media type to the nip, wherein the second medium includes a second surface, a second marking material on the second surface and a second interface between the second surface and the second marking material;

sensing the temperature of the third outer surface; and controlling the wrap length of the belt on the second outer surface to maintain a substantially constant temperature at the second interface of the second medium based on the temperature of the third outer surface.

21. The method of claim 20, further comprising:

determining a third relationship between the temperature at the second interface of the second media type and the wrap length of the belt on the second outer surface for a third temperature of the third outer surface;

determining a fourth relationship between the temperature at the second interface of the second media type and the wrap length of the belt on the second outer surface for a fourth temperature of the third outer surface;

determining a second transfer function relating the wrap length (WL) of the fuser belt on the second outer surface to the temperature (T) of the third outer surface, for a second value of the temperature at the second interface, using the third relationship and the fourth relationship, as follows: $WL=(C_3 \cdot T)+C_4$, where $C_3$ is the slope and $C_4$ is the y-intercept; and applying the second transfer function to control the wrap length of the belt on the second outer surface to achieve the second value of the temperature at the second interface for the second media type.

22. The method of claim 15, wherein:

the first roll is a fuser roll;

the third roll is an external pressure roll comprising an elastically deformable polymer including the third outer surface;

the belt is a continuous fuser belt;

the first marking material is toner; and the fuser belt and the pressure roll heat and apply pressure to the medium at the nip.

* * * * *